US006195843B1

(12) United States Patent
Graf

(10) Patent No.: US 6,195,843 B1
(45) Date of Patent: Mar. 6, 2001

(54) PROCESS AND APPARATUS FOR MANUFACTURING A SAW-TOOTHED WIRE

(75) Inventor: Ralph A. Graf, Freienbach (CH)

(73) Assignee: Graf & Cie AG, Rapperswil (CH)

( * ) Notice: Subject to any disclaimer, the term of this patent is extended or adjusted under 35 U.S.C. 154(b) by 0 days.

(21) Appl. No.: 09/205,471

(22) Filed: Dec. 4, 1998

(30) Foreign Application Priority Data

Dec. 8, 1997 (EP) ..... 97121612

(51) Int. Cl.[7] ..... D01G 15/84
(52) U.S. Cl. ..... 19/114; 76/112; 83/846
(58) Field of Search ..... 19/98, 99, 102, 19/103, 104, 105, 110, 111, 112, 113, 114; 140/97; 76/101.1, 112; 83/846; 29/34 D, 34 R

(56) References Cited

U.S. PATENT DOCUMENTS

| | | | | |
|---|---|---|---|---|
| 29,688 | * | 8/1860 | Germann | 76/112 |
| 85,417 | * | 12/1868 | Andrews | 76/112 |
| 2,141,504 | * | 12/1938 | Balfour et al. | 76/112 |
| 2,534,424 | * | 12/1950 | Dryden | 76/112 |
| 3,005,478 | * | 10/1961 | Laviano | 76/112 |
| 4,233,711 | * | 11/1980 | Hollingsworth | 19/114 |
| 4,453,431 | * | 6/1984 | Hollingsworth | 76/112 |
| 4,537,096 | * | 8/1985 | Hollingsworth | 76/112 |
| 4,653,152 | * | 3/1987 | Wada | 19/114 |
| 5,016,497 | * | 5/1991 | Sundstrom | 76/112 |
| 5,566,541 | * | 10/1996 | Stahlecker et al. | 19/114 |

FOREIGN PATENT DOCUMENTS

| | | |
|---|---|---|
| 0 382 899 | 8/1990 | (EP) . |
| 2 435 540 | 4/1989 | (FR) . |
| 2 258 471 | 2/1998 | (GB) . |
| 91 15605 | 10/1991 | (WO) . |

* cited by examiner

*Primary Examiner*—John J. Calvert
*Assistant Examiner*—Gary L. Welch
(74) *Attorney, Agent, or Firm*—Darby & Darby

(57) ABSTRACT

To improve the properties of all-steel card clothings, a saw-toothed wire is proposed with a foot portion and a plurality of teeth arranged consecutively in the lengthwise direction of the wire, the teeth issuing from the foot portion and each tooth ending in a single point, and where the interval between the points of two consecutive teeth is different from the interval between the points of other consecutive teeth.

6 Claims, 4 Drawing Sheets

(STATE OF THE ART)

PROCESS AND APPARATUS FOR MANUFACTURING A SAW-TOOTHED WIRE

BACKGROUND OF THE INVENTION

1. Field of the Invention

The present invention concerns a saw-toothed wire with a foot portion and a plurality of teeth arranged in linear sequence along the wire, each tooth issuing from the foot portion and ending in a single point; a process and apparatus for the manufacture of saw-toothed wires of this kind; and the use of saw-toothed wires of this kind for the processing of textile fibers.

All-steel card clothings made of a plurality of saw-toothed wires of the kind described above that are mounted parallel to each other on a carrier base have almost totally replaced the originally used needle-toothed card clothings in the processing of textile fibers. One reason for this is that all-steel card clothings of this kind are more wear-resistant and, as a consequence, offer the possibility of increasing the processing speed; another reason is the fact that saw-toothed wires of this kind are comparatively simple to manufacture.

2. Description of the Related Art

A state-of-the-art apparatus for manufacturing saw-toothed wires of the kind described at the beginning is shown in FIG. 4. This apparatus has a feed mechanism 410 mounted on a machine bed 400, by which a profile wire 450 is advanced along a given travel path 454. For this purpose, the profile wire 450 is clamped tight between two feed rollers 418, one of which is driven to turn about a rotational axis 420 that is perpendicular to the given travel path 454.

For working the profile wire 450, there is further a machine tool 430 mounted on the machine bed. This machine tool 430 comprises a spindle 436 running in bearings in a spindle stock 434 and driven by a 3-phase AC motor 432 to rotate in the direction shown by the arrow 437. A blanking tool holder 438 is mounted on the front end of the spindle 436 in a rotationally fixed connection. A blanking tool 440 that is mounted on the blanking tool holder 438 and works together with a blanking die 442 of the machine tool 430 provides the means for producing saw-teeth by blanking material-free portions out of the profile wire 450. The 3-phase AC motor 432, the spindle stock 434, the spindle 436 and the blanking die 442 are mounted together on a base plate 444 which can be swiveled in increments of 5° relative to the machine bed 400 and the feed mechanism 410, as indicated by the graduation marks of the angular scale 446.

Mounted at the front end of the spindle 436 is a bevel gear 412. This bevel gear 412 meshes with a bevel gear 414 that is attached in a rotationally fixed connection to that end of a worm gear that faces the machine tool. Thereby, the worm gear is made to turn about a rotational axis whose position is fixed in relation to the machine bed 400 and the feed mechanism 410. This rotation is transferred to a gear that meshes with the worm gear 416 and turns about the rotational axis 420 extending perpendicular to the given travel path 454. This allows the pair of feed rollers 418 to be driven by the 3-phase AC motor 432 via the worm gear 416, the bevel gear 414, the bevel gear 412 and spindle 436. This drive mechanism assures that the profile wire 450 is advanced each time by an equal feed interval in the direction indicated by arrow 452 between the individual work steps performed by the blanking tool 440.

Accordingly, the apparatus shown in FIG. 4, using only one drive motor and one machine tool, provides a particularly simple means of producing saw-toothed wires with a constant pitch, i.e., a constant interval between the points of consecutive teeth. The shape and pitch of the teeth of the saw-toothed wire produced in this manner depend on the position of the base plate 444 relative to the machine bed 400 and also on the feed mechanism 410, the blanking tool being used, and the transmission ratio effectuated by the worm gear 416 in combination with the gear that turns about the rotating axis 420.

When saw-toothed wires made with equipment of the kind shown in FIG. 4 are used in the processing of textile fibers, one observes, particularly at high processing speeds, an increase in damaged staple fibers and accumulations of non-aligned fibers, especially of short fibers (pilling effect).

SUMMARY OF THE INVENTION

In view of the problems with the existing state of the art, the object of the present invention is to provide a saw-toothed wire of the kind described at the beginning that enables a reliable and gentle processing of fibers while assuring a high degree of wear resistance combined with easy manufacturability, and to further provide an apparatus for the manufacture of saw-toothed wires of this kind.

In accordance with the invention, the problem is solved through saw-toothed wires in which the interval between the points of two consecutive teeth is different from the interval between other consecutive teeth, and through processes and devices for the manufacture of saw-toothed wires of this kind.

This solution of the inventive problem is founded on the insight that the observed damage of the staple fibers and other defects in the processing of fibers are traceable to the different requirements that a saw-toothed wire used in the processing of textile fibers must meet when penetrating into the fiber fleece, working the fiber fleece and leaving the fiber fleece. With the inventive saw-toothed wire, the tooth pitches of individual segments can be adapted to these different requirements, whereby an overall improvement of the processing result is achieved.

In this, it has proven to be particularly practical if the spacing between the points of consecutive teeth along a wire segment of given length changes continuously. To meet this condition, the spacing between the points of consecutive teeth may at first increase continuously, starting from a first given interval up to a second given interval, and then decrease continuously, starting from the second given interval back to the first given interval. From a manufacturing point of view, it has proven to be particularly advantageous if the amount of the difference between consecutive intervals between the points of consecutive teeth along a given wire segment is approximately constant.

The desired variation pattern of the pitch of saw-toothed wires according to the invention may be obtained, e.g., by forming material-free portions between the saw-teeth, the saw-teeth being of identical shape, e.g., of a triangular point shape, an arcuate tooth shape, or a truncated triangular point shape. To accomplish this purpose, it is envisaged, for example, to create material-free portions between two consecutive teeth through a number of consecutively performed operations with a machine tool, particularly a blanking tool. As an alternative, however, the saw-toothed wire may also comprise saw-teeth of differing shapes, e.g. of a rhomboid shape, that are separated from each other by material-free portions of identical shape. For the manufacture of saw-toothed wires of this kind, each of the material-free portions can be produced in a single operation.

For the manufacture of saw-toothed wires according to the invention, it has proven to be particularly practical if a relative motion of the profile wire in relation to a machine tool device is generated by means of a feed mechanism, and the profile wire, in the course of the relative motion, is subjected to successively performed operations, e.g., blanking operations, for producing the saw-teeth, wherein the feed mechanism is controlled in accordance with a given program for generating different amounts of feed travel between the successively performed operations.

In view of the generally expensive construction of the machine tool device, it is particularly advantageous if the profile wire is advanced by the feed mechanism along a given travel path and the individual operations by the machine tool device occur at a given location along the travel path.

In this, the attainment of the desired pitch variation pattern can be assured by registering the operating position of the machine tool device and controlling the feed mechanism based on the registered operating position. If the machine tool device has a rotatable milling spindle with a blanking tool attached to it, the angular position of the milling spindle can be continuously registered by means of an angular decoder, and the feed mechanism can be controlled on the basis of the angular position that has been determined in this manner.

In order to compensate and thereby eliminate possible spacing errors that could possibly occur with this kind of control, it has proven to be particularly practical if the feed travel of the profile wire, too, is continuously registered and the feed mechanism and/or the machine tool device is controlled on the basis of the registered feed travel. For this purpose, the feed mechanism may comprise a feed roller that is brought to bear against the profile wire and whose angular position is continuously registered by a second angular decoder.

BRIEF DESCRIPTION OF THE DRAWING

In the following, the invention is explained in correlation with the drawing, which is also being explicitly referred to with regard to all details essential to the invention that are not closely portrayed in the description.

In the drawing.

DETAILED DESCRIPTION OF THE INVENTION

Figure 1:
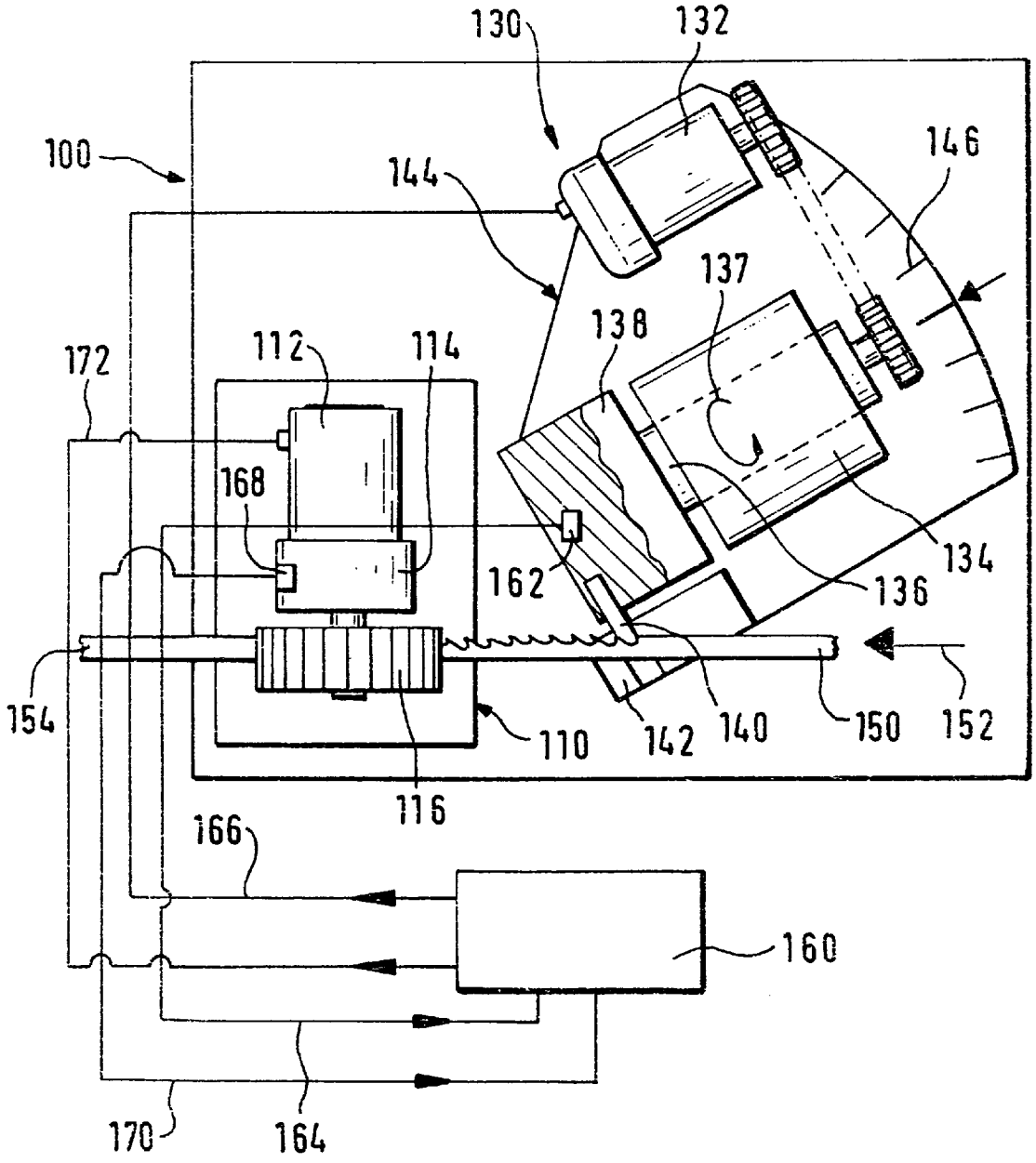
FIG. 1 shows an apparatus in accordance with the invention for the manufacture of a saw-toothed wire.

The apparatus illustrated in FIG. 1 comprises a feed mechanism 110 and a machine tool 130, both mounted on a machine bed 100. The feed mechanism 110 essentially consists of a servo motor 112, a reduction gear box 114 and a pair of feed rollers 116 between which a saw-toothed wire 150 is tightly held. One feed roller of the feed roller pair 116 is mounted directly on the shaft of the reduction gear box 114, so that through the rotation of this feed roller in the direction indicated by arrow 152, the profile wire 150 is advanced along a given feed path 154.

The machine tool 130 essentially consists of a servo motor 132 and a spindle 136 that runs in bearings contained in a spindle stock 134 and can be driven by the servomotor 132 in the direction indicated by arrow 137. At the front end of the spindle 136, a blanking tool holder 138 is mounted in a rotationally fixed connection. Fastened to the blanking tool holder 138 is a blanking tool 140 which, working together with the blanking die 142, serves to punch material-free portions out of the profile wire 150 for the purpose of making saw-teeth. The servo motor 132, the spindle stock 134 and thus the spindle 136 itself, as well as the blanking die 142, are mounted on a base plate 144 that can be swiveled in steps of 5° relative to the machine bed and thus also in relation to the feed mechanism 110, as indicated by the graduation marks of the angular scale 146.

The servo motor 132 of the machine tool 130 is controlled in accordance with a given program by a controller 160 via a control line 166. At the same time, the angular position of the spindle 136 is registered by an angular decoder 162 and transmitted to the controller 160 via a line 164. Dependent on the angular position of the spindle 136 as registered by the angular decoder 162, the servomotor 112 of the feed mechanism 110 is controlled by the controller 160 via a control line 172. The feed advance of the saw-toothed wire 150 along the feed path 154, which is caused by the action of the servo motor 112 of the feed mechanism 110, is registered by an angular decoder 168. A signal representing the registered feed advance is transmitted from the angular decoder 168 to the controller 160 via a line 170. This makes it possible to continuously monitor whether or not the feed advance that was determined by the program based on the angular position of the spindle 136 was indeed transferred to the profile wire 150 via the reduction gear box 114. In case the feed advance deviates from the amount that was determined by the given program, the control of the servo motor 112 via the control line 172 can at once be adjusted correspondingly. In this manner, the angle of rotation of the feed roller pair relative to each turn of the spindle 136 can be adjusted with infinite variability. This makes it possible to effect a feed advance of the profile wire between the feed roller pair in steps of 0.01 mm. With the just described mode of operation of the apparatus represented in FIG. 1, the servo motor 132 of the machine tool 130 serves as "master" and the servo motor 112 of the feed mechanism 110 serves as "slave".

In the inventive apparatus, the known mechanical coupling between the spindle of the machine tool and the advance mechanism is replaced by an electronic coupling. This electronic coupling is effected by means of the controller 160 with the given program, wherein the parallel operation of both servo motors 132 and 112 is of utmost importance, particularly in the start and stop phases.

With the apparatus as described, the tooth pitches can be continuously varied. This is accomplished by defining in the given program the period, called cycle length, in millimeters over which the variation is to take place and by specifying the size of the incremental difference per tooth in the variation pattern of the tooth pitch.

For the manufacture of different saw-toothed wires by means of the apparatus shown in FIG., 1 one only has to change the parameters of the tooth pitch in the given program and, if necessary, to swivel the spindle relative to the feed mechanism 110 and, possibly, to exchange the blanking tool 140.

Figure 2A:
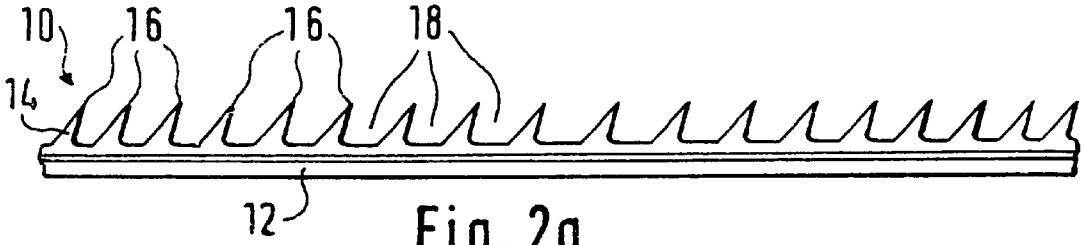
FIGS. 2*a* to 2*d* show embodiments of saw-toothed wires according to the invention.
Figure 2B:
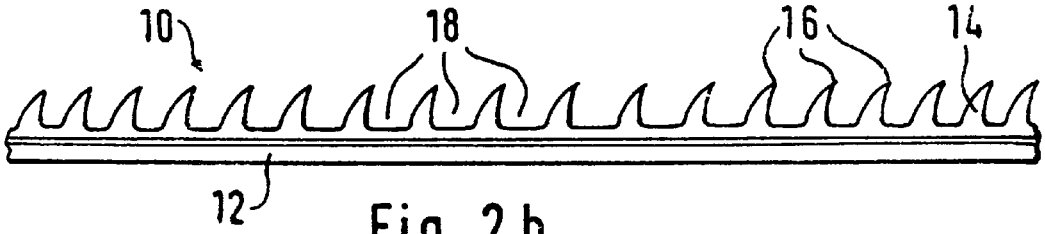
Figure 2C:
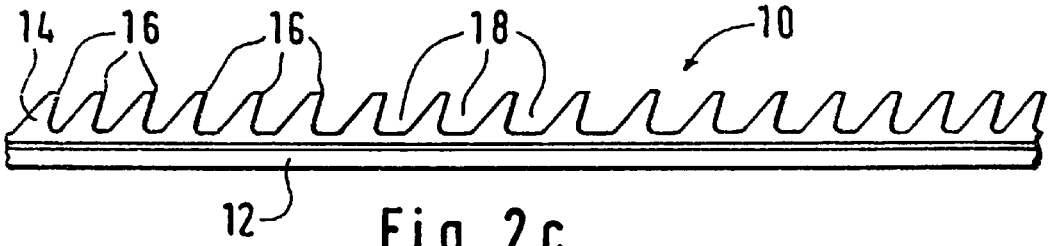

By means of the apparatus shown in FIG. 1, it is possible to produce saw-toothed wires of variable pitch of the kinds shown in FIGS. 2*a*) to 2*c*).

Each of these saw-toothed wires 10 has a foot portion 12 with a plurality of teeth 14 that are arranged consecutively in the lengthwise direction of the wire, each of the teeth issuing from the foot portion 12 and ending in a point 16. In the saw-toothed wires shown in FIG. 2, the spacing between the points of consecutive teeth, i.e., the tooth pitch, increases at first continuously along a first wire segment of given length, whereupon it decreases along a second wire segment of given length. In the saw-toothed wires shown in the FIGS. 2*a*) to 2*c*) with saw-teeth in triangular point shape, arcuate tooth shape, or truncated triangular point shape, this is accomplished by varying the shape of the material-free portion 18 between the individual teeth. To meet this purpose, the apparatus of FIG. 1 can cut the individual material-free portions 18 by performing a corresponding number of blanking steps.

Figure 2D:
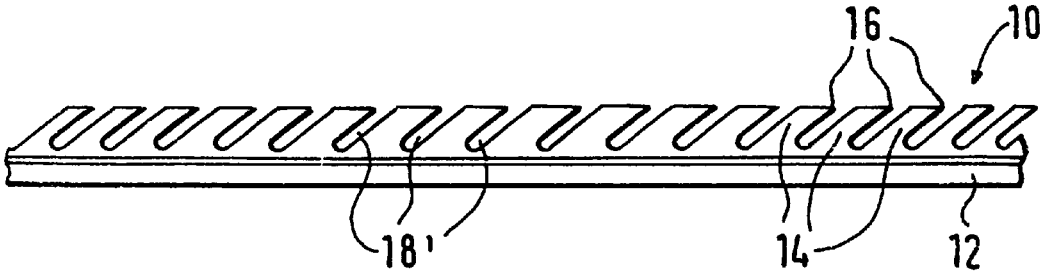

In the saw-toothed wire represented in FIG. 2*d*), the continuous variation of the tooth pitch is attained by providing the essentially rhomboid-shaped teeth with a variable shape and separating them with material-free portions of identical shape. To produce saw-toothed wires of this kind, each material-free portion 18' can be cut by the apparatus shown in FIG. 1 with only one blanking step, while between the individual blanking steps, the amount of feed advance of the profile wire is being varied.

Figure 3A:
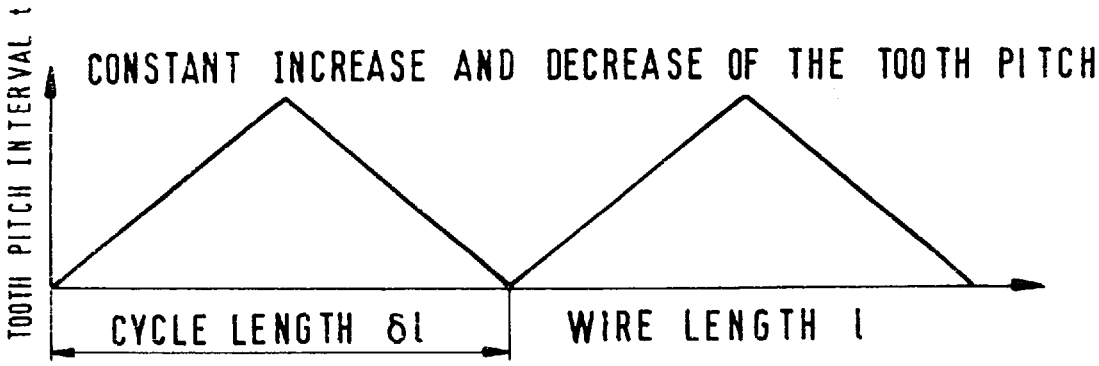
FIGS. 3*a* to 3*c* show pitch variation patterns that can be made with the apparatus according to FIG. 1.
Figure 3B:
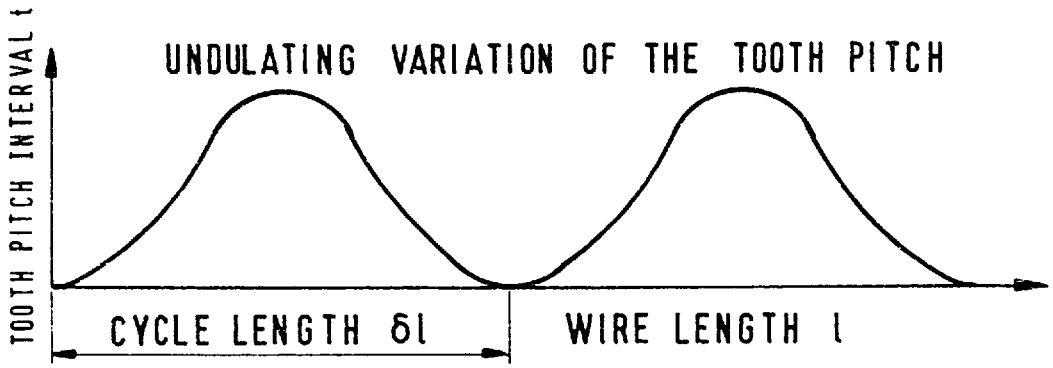
Figure 3C:
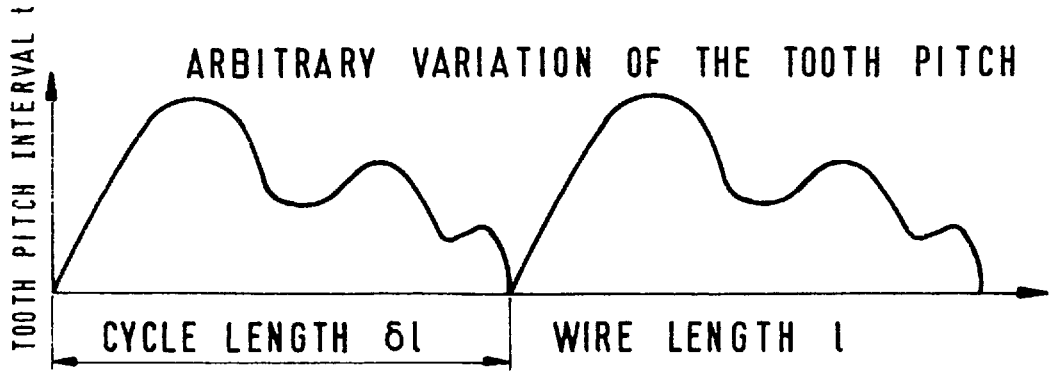
Figure 4:
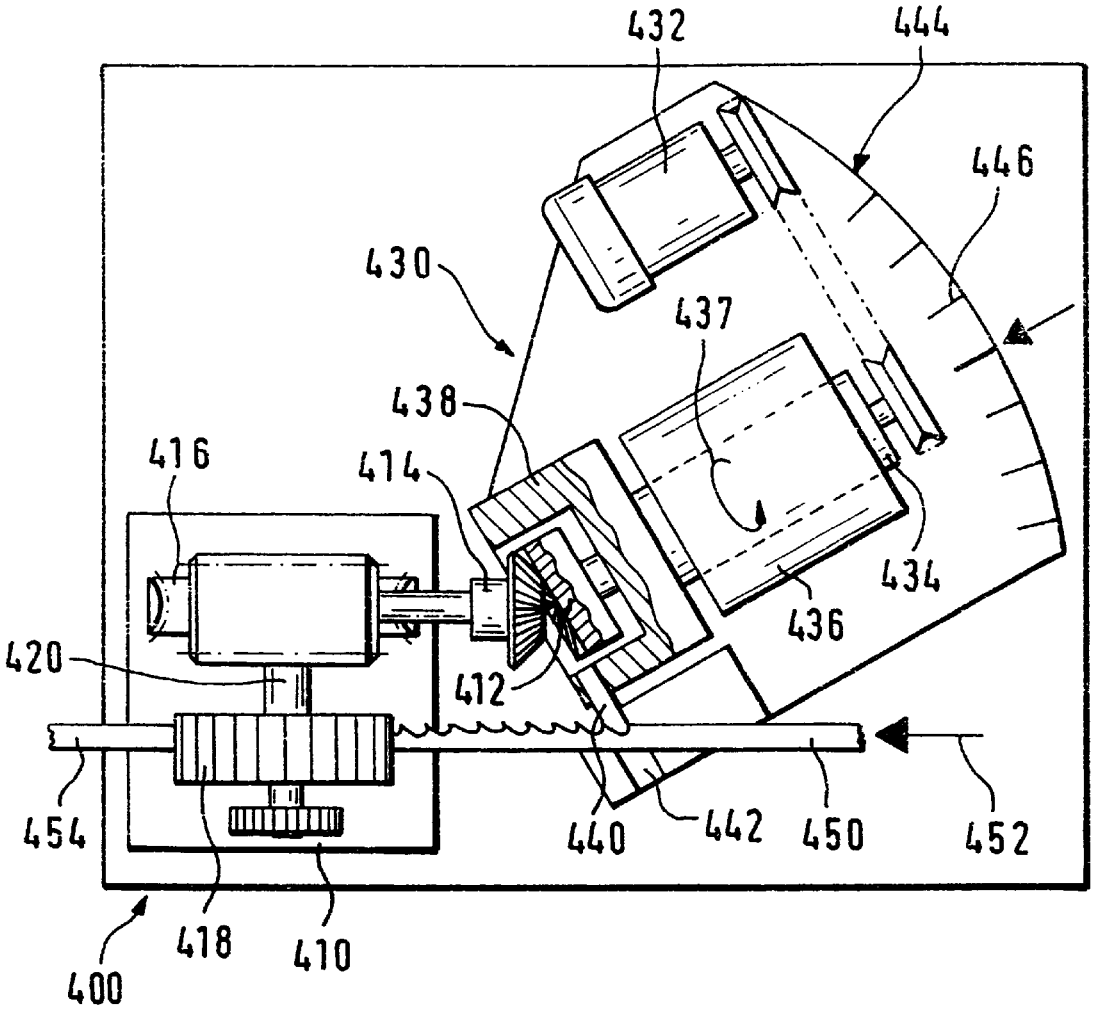
FIG. 4 shows an apparatus for manufacturing saw-toothed wires according to the existing state of the art.

FIG. 3 shows pitch variation patterns of saw-toothed wires that can be produced with the apparatus of FIG. 1. For example, according to FIG. 3*a*), it is possible with a given program to produce a pitch variation pattern in which the spacing between the points of consecutive teeth along a wire segment of a given length $\delta 1$ increases at first continuously, starting from a first given interval up to a second given interval, and then decreases continuously from the second given interval to the first given interval, with the amount of the difference between consecutive intervals between the points of consecutive teeth being about constant. However, as shown in FIGS. 3*b*) and 3*c*), the pitch variation pattern can also be of an undulating or arbitrarily variable design.

The invention is not limited to the embodiments that are represented by the drawing. For example, it is also possible to produce saw-toothed wires in accordance with the invention that have different tooth shapes. As an alternative to the mode of operation shown in FIG. 1, it is also envisaged that the servo motor 112 of the feed mechanism 110 be used as master and the servo motor 132 of the machine tool 130 be used as slave.

What is claimed is:

1. A process for manufacturing a saw-toothed wire having saw-teeth arranged consecutively in a lengthwise direction of the wire and points of consecutive teeth are spaced from one another at variable intervals comprising the steps of:

producing a relative motion between a profile wire and a machine tool device by a feed mechanism subjecting the profile wire, during the relative motion, to consecutively performed operations to form the saw-teeth, wherein the machine tool comprises a rotatable spindle having a blanking tool attached to the spindle;

controlling the feed mechanism based on a program to vary an amount of feed travel between the consecutively performed operations;

detecting an operation position of the machine tool device; and controlling the feed mechanism based on the detected operation position;

detecting an angular position of the spindle; and controlling the feed mechanism based on the detected angular position.

2. A process for manufacturing a saw-toothed wire having saw-teeth arranged consecutively in a lengthwise direction of the wire and points of consecutive teeth are spaced from one another at variable intervals, comprising the steps of:

producing a relative motion between a profile wire and a machine tool device by a feed mechanism subjecting the profile wire, during the relative motion, to consecutively performed operations to form the saw-teeth, wherein the profile wire is advanced by the feed mechanism along a predetermined travel path and the operations of the machine tool device are performed at a predetermined location along the travel path;

controlling the feed mechanism based on a program to vary an amount of feed travel between the consecutively performed operations;

detecting a feed travel of the profile wire; and controlling the feed mechanism based on the detected amount of feed travel.

3. A process for manufacturing a saw-toothed wire having saw-teeth arranged consecutively in a lengthwise direction of the wire and points of consecutive teeth are spaced from one another at variable intervals, comprising the steps of:

producing a relative motion between a profile wire and a machine tool device by a feed mechanism subjecting the profile wire during the relative motion to consecutively performed operations to form the saw-teeth, wherein the profile wire is advanced by the feed mechanism along a predetermined travel path and the operations of the machine tool device are performed at a predetermined location along the travel path;

controlling the feed mechanism based on a program to vary an amount of feed travel between the consecutively performed operations;

detecting a feed travel of the profile wire; and controlling the machine tool device based on the detected amount of feed travel of the profile wire.

4. A process for manufacturing a saw-toothed wire having saw-teeth arranged consecutively in a lengthwise direction of the wire and points of consecutive teeth are spaced from one another at variable intervals, comprising the steps of:

producing a relative motion between a profile wire and a machine tool device by a feed mechanism subjecting the profile wire, during the relative motion, to consecutively performed operations to form the saw-teeth, wherein the profile wire is advanced by the feed mechanism along a predetermined travel path and the operations of the machine tool device are performed at a predetermined location along the travel path;

controlling the feed mechanism based on a program to vary an amount of feed travel between the consecutively performed operations, wherein the feed mechanism comprises a feed roller displaceable so as to contact the profile wire;

detecting an angular position of the feed roller; and controlling the feed mechanism based on the detected angular position of the feed roller.

5. An apparatus for manufacturing a saw-toothed wire having saw-teeth, comprising:

a machine tool for forming the saw-teeth arranged consecutively in a lengthwise direction of a profile wire, the machine tool being adapted to produce consecutive teeth spaced at variable intervals between respective points of the consecutive teeth;

a feed mechanism for producing relative motion between the profile wire and the machine tool;

a controller controlling the feed mechanism to vary amounts of feed travel between consecutive operations of the machine tool based on a predetermined program; and wherein the machine tool comprises a rotatable spindle and a first angular decoder for detecting an angular position of the spindle, the feed mechanism being adjustable based on the detected angular position of the spindle.

6. An apparatus for manufacturing a saw-toothed wire having saw-teeth, comprising:

a machine tool for forming the saw-teeth arranged consecutively in a lengthwise direction of a profile wire, the machine tool being adapted to produce consecutive teeth spaced at variable intervals between respective points of the consecutive teeth;

a feed mechanism for producing relative motion between the profile wire and the machine tool; and a controller controlling the feed mechanism to vary amounts of feed travel between consecutive operations of the machine tool based on a predetermined program;

the profile wire is displaceable along a predetermined feed path via the feed mechanism, the operations of the machine tool being performed at a predetermined location along the feed path;

wherein the feed mechanism comprises a feed roller displaceable so as to contact the profile wire; and wherein the feed mechanism further comprises a second angular decoder for detecting an angular position of the feed roller.

* * * * *